US010593315B2

(12) United States Patent
Rouleau

(10) Patent No.: US 10,593,315 B2
(45) Date of Patent: Mar. 17, 2020

(54) CHIME APPARATUS

(71) Applicant: CARILLONS OPÉRA INC., Montréal, Québec (CA)

(72) Inventor: Daniel Rouleau, Québec (CA)

(73) Assignee: CARILLONS OPÉRA INC., Montréal, Québec (CA)

( * ) Notice: Subject to any disclaimer, the term of this patent is extended or adjusted under 35 U.S.C. 154(b) by 0 days.

(21) Appl. No.: 16/079,913

(22) PCT Filed: Feb. 27, 2017

(86) PCT No.: PCT/CA2017/050249

§ 371 (c)(1),
(2) Date: Aug. 24, 2018

(87) PCT Pub. No.: WO2017/143458

PCT Pub. Date: Aug. 31, 2017

(65) Prior Publication Data

US 2019/0073989 A1 Mar. 7, 2019

Related U.S. Application Data

(60) Provisional application No. 62/300,398, filed on Feb. 26, 2016.

(51) Int. Cl.

| | |
|---|---|
| ***G08B 3/00*** | (2006.01) |
| ***G10K 1/064*** | (2006.01) |
| ***G10K 1/06*** | (2006.01) |

(52) U.S. Cl.
CPC ..... *G10K 1/064* (2013.01); *G10K 1/06* (2013.01)

(58) Field of Classification Search
CPC ..... G10K 1/064; G10K 1/06; G04G 13/00; G10D 13/08; G10H 1/26; G10H 2230/351

(Continued)

(56) References Cited

U.S. PATENT DOCUMENTS 1,781,927 A 5/1929 Klein
4,677,892 A * 7/1987 Kramer ..... G10K 1/062 116/155

(Continued)

FOREIGN PATENT DOCUMENTS

CA 2411708 A1 5/2003

OTHER PUBLICATIONS

Corresponding International Application No. PCT/CA2017/050249, International Search Report & Written Opinion dated May 16, 2017.

*Primary Examiner* — Toan N Pham
(74) *Attorney, Agent, or Firm* — Cooper Legal Group, LLC

(57) ABSTRACT

A chime apparatus for producing a sound in response to an actuation signal is provided. The chime apparatus comprises a support frame, a bell, a hammer assembly and a chiming mechanism. The support frame has an opened bottom end, and the bell is hanging from the opened bottom end. The hammer assembly comprises an L-shaped lever and a hammer head. The L-shaped lever has a lever fulcrum and is pivotally mounted to the support frame. The L-shaped lever has a first and a second lever segments orthogonally projecting from the lever fulcrum, and the hammer head is affixed to an extremity of the first lever segment opposite the fulcrum. The chiming mechanism comprises a plunger element and an actuator. The plunger element is vertically movable in the support frame, and the actuator is operatively connected to the plunger element.

19 Claims, 9 Drawing Sheets

(58) Field of Classification Search
USPC ..... 340/392.1, 392.4, 392.5, 395.1
See application file for complete search history.

(56) References Cited

U.S. PATENT DOCUMENTS

| | | | | |
|---|---|---|---|---|
| 7,534,949 | B1 | 5/2009 | Estes | |
| 2015/0338828 | A1* | 11/2015 | Behra ..... | G04B 21/02<br>368/272 |

* cited by examiner

CHIME APPARATUS

TECHNICAL FIELD

The technical field generally relates to chimes and more particularly concerns an actuation mechanism for producing a sound with a tubular bells chime or the like.

BACKGROUND

Conventional mechanisms used in tubular chimes for residential bells rely on the use of different means for striking the tubular bells. Those different means dictate the minimum dimensions that the tubular chimes may have. The use of the conventional mechanisms also has a considerable impact on the quality of the sound produced, and on the aesthetic properties of these tubular chimes.

There is thus a for an actuation mechanism for producing a sound that addresses at least some of the challenges presented above.

SUMMARY

In accordance with one aspect, there is provided a chime apparatus for producing a sound in response to an actuation signal. The chime apparatus includes a support frame, a bell, a hammer assembly, and a chiming mechanism. The bell hangs from the support frame. The hammer assembly includes an L-shaped lever and a hammer head. The L-shaped lever has a lever fulcrum and is pivotally mounted to the support frame. The L-shaped lever has a first and a second lever segments orthogonally projecting from the lever fulcrum. The hammer head is affixed to an extremity of the first lever segment opposite the fulcrum. The chiming mechanism includes a plunger element being vertically movable in the support frame, and an actuator operatively connected to the plunger element.

In some embodiments, the chiming mechanism is configured such that in response to the actuation signal, the plunger element moves in a downward direction and engages with the second lever segment of the L-shaped lever, the L-shaped lever pivots, moving the hammer head away from the bell, and wherein the plunger element thereafter moves in an upward direction and releases the L-shaped lever so that the hammer head freely falls to strike the bell to produce the sound.

In one embodiment, the support frame has an opened bottom end.

In one embodiment, the bell is hung from the opened bottom end of the support frame.

In one embodiment, the support frame includes a mounting bracket, a pair of sidewalls suspended from the mounting bracket, and suspension elements for connecting the sidewalls to the mounting bracket.

In one embodiment, the suspension elements are pieces of felt.

In one embodiment, the bell is a tubular bell has a top opened end and a bottom opened end.

In one embodiment, the bell includes a hole extending through the bell, proximate the top opened end.

In one embodiment, the chime apparatus includes a bell hanging assembly. The bell hanging assembly includes a horizontal slot provided on each one of the pair of sidewalls, a bell supporting element mounted to the horizontal slot, and a rope passing through the hole of the bell. The rope is attached to the bell supporting element.

In one embodiment, the chime apparatus includes a bell hanging assembly. The bell hanging assembly includes a horizontal slot provided on each one of the pair of sidewalls. The horizontal slot includes a toothed side including a plurality of individual tooth. The bell hanging assembly also includes a rope passing through the hole of the bell. The rope is engaged with one individual tooth of the toothed side of the horizontal slot.

In one embodiment, the L-shaped lever is made of acrylic.

In one embodiment, the L-shaped lever has a top surface provided with a sliding pad.

In one embodiment, the hammer head is a balanced weight.

In one embodiment, the hammer head includes a contacting element affixed to the hammer head. The contacting element is positioned to contact the bell when the hammer head strikes the bell.

In one embodiment, the plunger element includes a top portion and a bottom portion. The top portion includes a plunger shaft having a top end and a bottom end, a stopper flange attached to a top end of the plunger shaft, and a spring wound about the plunger shaft. The bottom portion includes a plunger stem mechanically connected to the bottom end of the plunger shaft, and a contact ball fastened at a bottom end of the plunger stem.

In one embodiment, the contact ball is made of high-crystalline thermoplastic polymer.

In one embodiment, the chime apparatus includes a pivoting shaft, wherein the L-shaped lever is pivotally mounted to the support frame with the pivoting shaft.

In one embodiment, the actuator is a solenoid.

In one embodiment, the chime apparatus includes an actuator housing for housing the solenoid. The actuator housing is mounted into the support frame and has a top wall traversed by a hole.

In one embodiment, the actuator is configured to receive the actuation signal from an external source.

In accordance with another aspect, there is provided a chime apparatus which produces a sound in response to an actuation signal.

In some embodiments, the chime apparatus generally includes a support frame, a bell, a hammer assembly and a chiming mechanism.

The support frame has an opened bottom end and the bell may be hung from the opened bottom end of the support frame.

The hammer assembly comprises an L-shaped lever and a hammer head. The L-shaped lever has a lever fulcrum and is pivotally mounted to the support frame. Furthermore, the L-shaped lever has a first and a second lever segments orthogonally projecting from the lever fulcrum. The hammer head is affixed to an extremity of the first lever segment opposite the fulcrum and may be extending next to the bell.

The chiming mechanism comprises a plunger element which is vertically movable in the support frame. An actuator is generally operatively connected to the plunger element. The actuator may be embodied by a solenoid and configured to receive an actuation signal from an external source. In response to the actuation signal, the plunger element may move in a downward direction and engage with the second lever segment of the L-shaped lever. The L-shaped lever hence pivots, moving the hammer head away from the bell. The plunger element may thereafter move in an upward direction, thus releasing the L-shaped lever so that the hammer head freely falls to strike the bell and produces a sound.

Other features and advantages of the invention will be better understood upon reading of preferred embodiments thereof with reference to the appended drawings.

BRIEF DESCRIPTION OF THE DRAWINGS

FIGS. 1A and 1B illustrate a chime apparatus having a support frame and an opened bottom end according to one embodiment. FIG. 1C shows the support frame, in accordance with one embodiment.

DETAILED DESCRIPTION

Figure 1C:
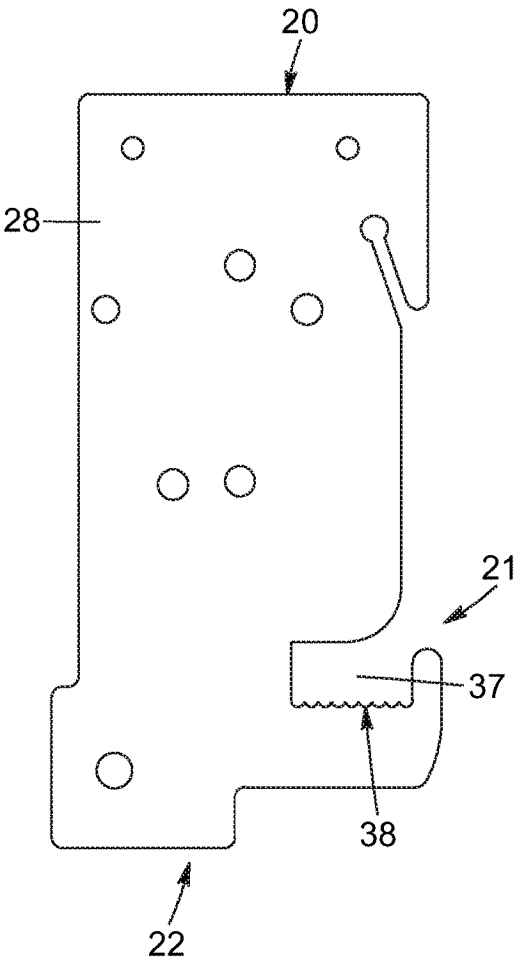
FIG. 1A to FIG. 1C show a chime apparatus for producing a sound.

In the following description, similar features in the drawings have been given similar reference numerals. In order to not unduly encumber the figures, some elements may not be indicated on some figures if they were already mentioned in preceding figures. It should also be understood herein that the elements of the drawings are not necessarily drawn to scale and that the emphasis is instead being placed upon clearly illustrating the elements and structures of the present embodiments.

In accordance with embodiments, there is provided a chime apparatus for producing a sound in response to an actuation signal. Some embodiments of the present invention may be particularly useful in tubular bells chimes. Embodiments described herein below permit the fabrication of compact tubular bells chimes, conjugating aesthetics properties and sound quality required by the market for such products. In one implementation, the chime apparatus may be used in residential door chime application, the chime apparatus producing one or more sounds in response to the activation of the doorbell mechanism. Alternatively, the chime apparatus may be used in clock, commercial door chime, alarm device, or the like.

Figure 1B:
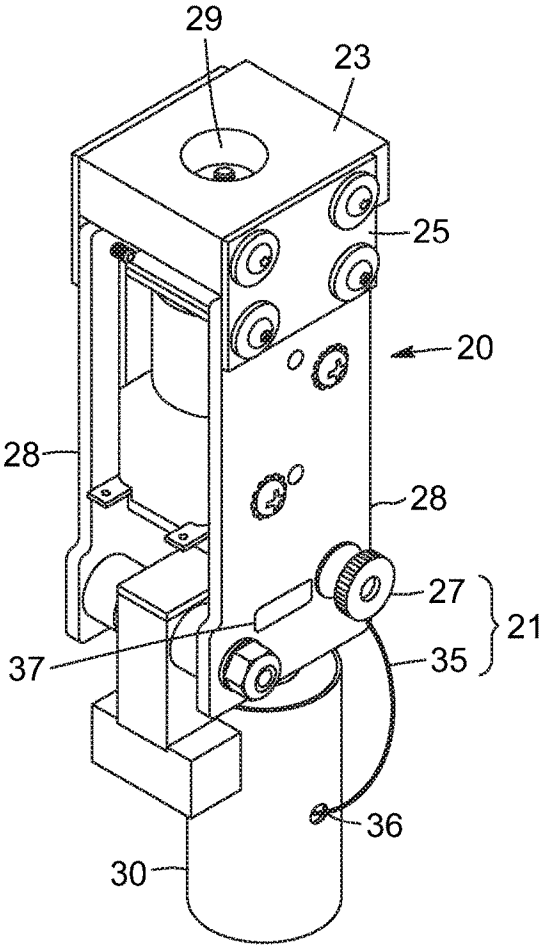
Figure 1A:
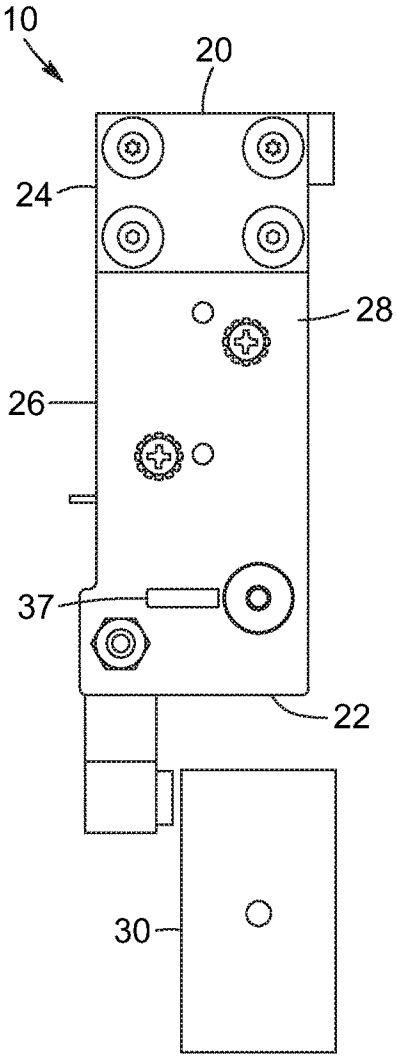

Referring to FIG. 1A and FIG. 1B, an embodiment of a chime apparatus 10 for producing a sound in response to an actuation signal is shown.

The chime apparatus 10 includes a support frame 20 having an opened bottom end 22. The support frame 20 can be made of polymer, metal, felt, combinations thereof, or any other suitable materials having the desired structural properties. It will be understood that the support frame 20 is embodied by a plurality of components assembled together defining a space that admits the insertion of a plurality of elements.

In the illustrated embodiment of FIG. 1B, the support frame 20 includes sidewalls 28 and a mounting bracket 23, each sidewall 28 being connected to the mounting bracket 23 via a corresponding suspension element 25, the support frame 20 defining an inverted U-shaped form. Each suspension element 25 may be embodied by a piece of felt attached to the corresponding sidewall 28 and the mounting bracket 23, allowing the sidewalls 28 to be suspended from the mounting bracket 23. Suspension of the sidewalls 28 using felt or another material having soundproofing properties may be particularly useful to prevent the chime apparatus 10 from unwanted resonance and to reduce noise associated with the operation of the chime apparatus 10. In the embodiment shown on FIG. 1B, the mounting bracket 23 has a hole defining a passage 29.

The chime apparatus 10 also includes a bell 30 hanging from the opened bottom end 22 of the support frame 20. The bell can be made of metal, brass, alloy, ceramic material, glass or any monolithic elements which resonate upon being struck.

Figure 2A:
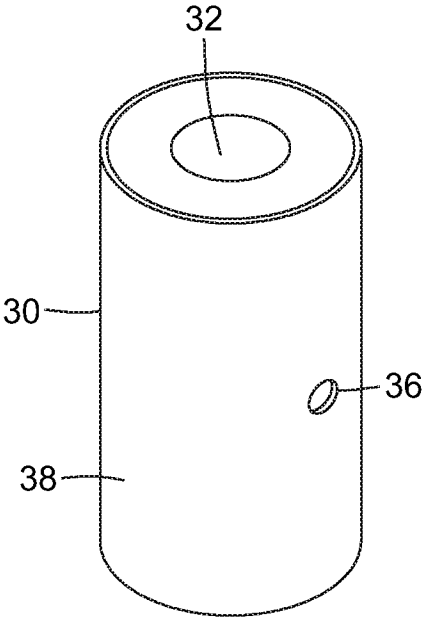
FIG. 2A to 2C illustrate different views of a bell according to one embodiment.
Figure 2B:
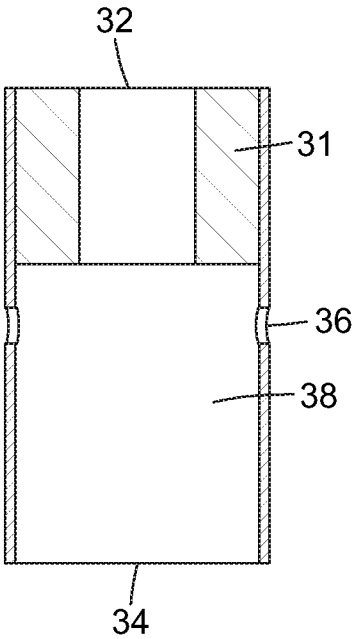
Figure 2C:
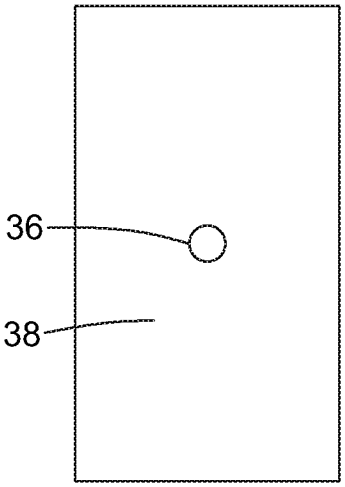

Referring now to FIG. 2A to FIG. 2C, in one embodiment the bell 30 is a tubular bell, and includes a hollow cylinder 38 having a top opened end 32 and a bottom opened end 34. A hole 36 extends radially through the hollow cylinder 38. Preferably, an end piece 31 is inserted into the top opened end 32 of the hollow cylinder to improve the sound quality of the chime apparatus 10. It will be readily understood that although the illustrated embodiment shows a tubular-shaped bells, in other variants the bell may have a different shape, such as a cup or curved shape, a rectilinear shape, or the like. In other embodiments, the bell 30 may be embodied by any other idiophone instruments, for example a cavity resonator, such as marimba, metallophone or xylophone, or the like.

In some embodiments, and now referring back to FIG. 1B, the chime apparatus 10 also includes a bell hanging assembly 21. The bell hanging assembly 21 may be embodied by a plurality of elements which conjointly allows the bell 30 to be hung. In the illustrated variant, the bell hanging assembly 21 includes a pair of bell supporting elements 27, for example knob-shaped, each mounted to a respective one of the side walls 28 close to the opened bottom end 22 of the support frame 20, and a rope 35. The rope 35 passes through the bell 30 via the hole 36 and is attached to the bell supporting elements 27, allowing the bell 30 to be hung under the opened bottom end 22 of the support frame 20. In the illustrated embodiment, each side wall 28 comprises a horizontal slot 37 in which is inserted the corresponding bell supporting elements 27. The bell supporting element 27 may be moved within the horizontal slot 37 to adjust the horizontal position of the bell 30 which respect to the support frame 20. Such an adjustment may for example be helpful to prevent the chime mechanism 10 from a bounce back effect.

In some embodiments, and now referring to FIG. 1C, each side wall 28 comprises a horizontal slot 37 forming an open-ended structure near the opened bottom end 22 of the support frame 20. In the illustrated variant, the horizontal slot 37 comprises a toothed side 38 including a plurality of individual tooth. The chime apparatus 10 may comprise two horizontal slots 37. The rope 35, as previously described, may pass through the bell 30 via the hole 36, but is, in this variant, engaged with one individual teeth of the toothed side 38 provided on each of the horizontal slot 37, hence allowing the bell 30 to be hung proximate the opened bottom end 22 of the support frame 20. The rope 35 may be moved within the open-ended structure along the toothed side 38, so as to adjust the horizontal position of the bell 30 which respect to the support frame 20.

The chime apparatus 10 further includes a hammer assembly 40 which includes an L-shaped lever 50 and a hammer head 60. It will be understood that the hammer assembly 40 is embodied by a plurality of components assembled together aimed at striking the bell.

Figure 3C:
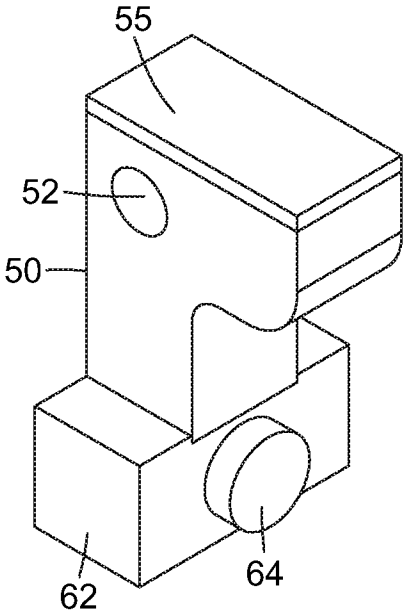
FIG. 3A to 3C are images of a hammer assembly made of a L-shaped lever and a hammer head used to strike the bell according to one embodiment.
Figure 3B:
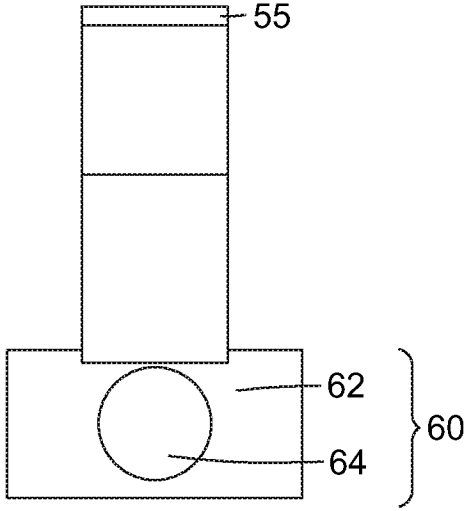
Figure 3A:
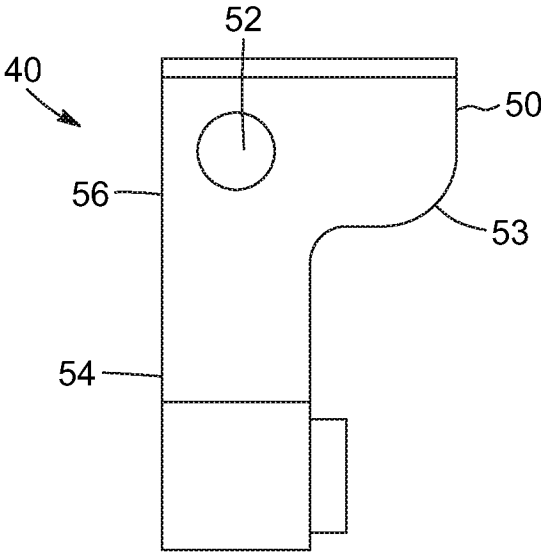

With reference to FIG. 3A to FIG. 3C and in accordance with one embodiment, the L-shaped lever 50 has a lever fulcrum 52 mounted to the support frame 20 and first and second lever segments 54 and 56, orthogonally projecting from said lever fulcrum 52. The hammer head 60 is affixed to an extremity of the first lever segment 54 opposite the fulcrum 52 and extending next to the bell 30.

The L-shaped lever 50 is for example made from acrylic and is preferably provided with a sliding-pad 55, extending from end to end of the top surface of the L-shaped lever second segment 52. Furthermore, the second lever segment 56 has a rounded corner 53 diametrically opposite the fulcrum 52 and orthogonally opposite the sliding-pad 55. The hammer head 60 includes a balanced weight 62 and a contact 64. In the illustrated example, the balanced weight 62 has a rectangular cuboid shape and is preferably made of brass. The contact 64 has a discoidal form and is made of plastic. Alternatively, the contact can also be made of wood, copper, metal, or any other material, which may be selected in view in the desired sound effect. The contact 64 is affixed to the hammer head and is to be put into contact with the bell 30 when the hammer head 60 strikes the bell 30.

The chime apparatus 10 further includes a chiming mechanism 70. The chiming mechanism is generally embodied by a group of components assembled together to act on the hammer assembly to produce a sound in response to an actuation signal.

Figure 5B:
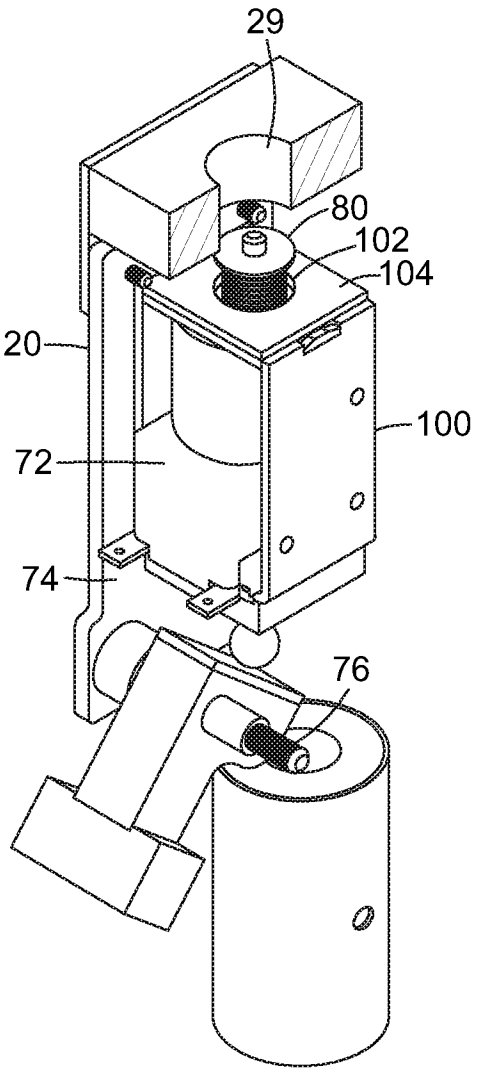
FIG. 5A and FIG. 5B are images showing a solenoid held in an actuator housing inserted into the support frame.
Figure 5A:
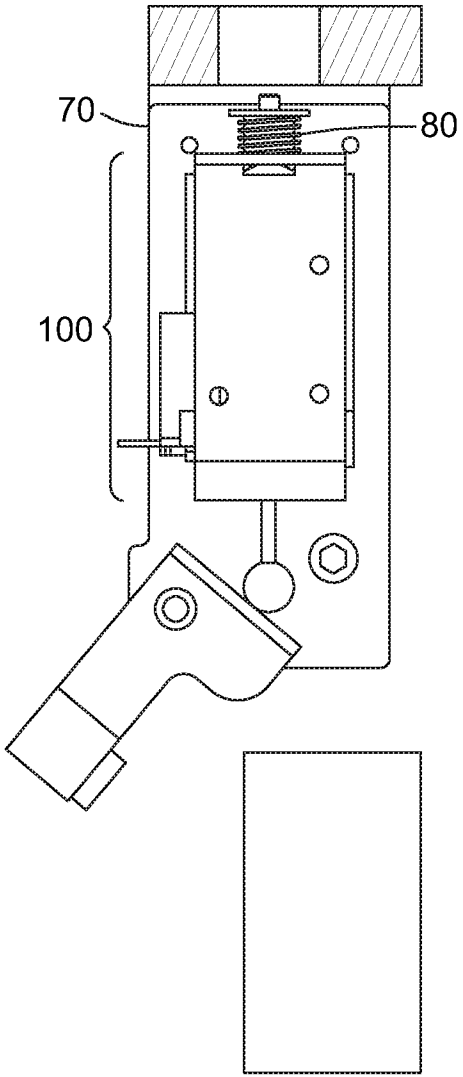

In the illustrated embodiment of FIG. 5A and FIG. 5B, the chiming mechanism 70 generally includes a plunger element 80 movable vertically in the support frame 20 and an actuator 72 operatively connected to the plunger element 80. The plunger element 80 can be made of metal, plastic, combinations thereof or any materials having the required structural properties. The actuator 72 can be made of metal, alloy, combinations thereof or any other materials having the desired electromagnetic properties. It will be understood that the plunger element is a group of components assembled together. It will further be understood that the actuator 72 may be a monolithic element or embodied by a plurality of components assembled together aiming at actuating the plunger element 80 upon the reception of an actuation signal provided by an external source.

Figure 4:
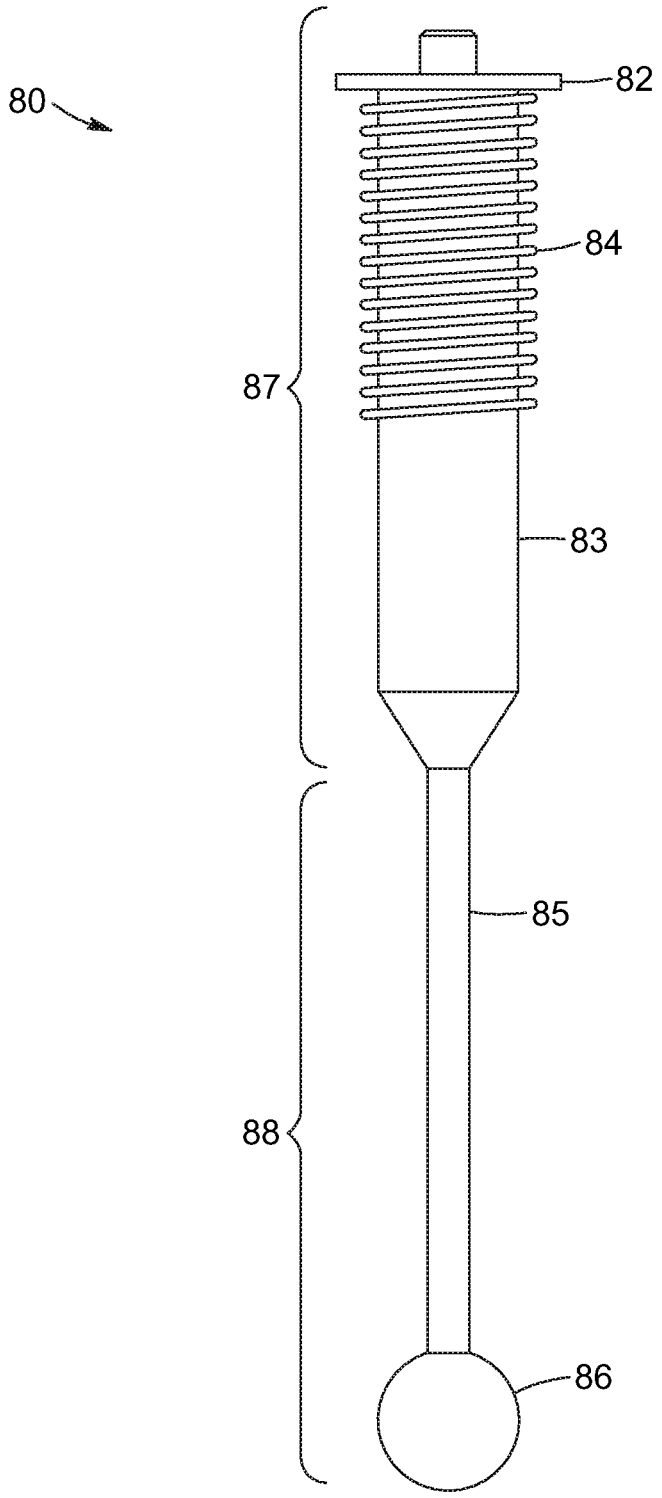
FIG. 4 shows a plunger element used to engage with the L-shaped lever of the hammer assembly according to one embodiment.

Referring to FIG. 4, in one embodiment the plunger element 80 has a top and a bottom portion 87 and 88. The top portion 87 of the plunger element 80 includes a plunger shaft 83, a stopper flange 82 attached to the top end of the top portion 87 of the plunger element 80 and a spring 84 wound about the plunger shaft 83. The bottom portion 88 of the plunger element 80 comprises a plunger stem 85 mechanically connected to one end of the plunger shaft 83, opposite the stopper flange 82, and a contact ball 86 fastened at the bottom end of the bottom portion 88 of the plunger element 88.

In some embodiments, the ball 86 is made of a highly-crystalline thermoplastic polymer suitable for use in high load mechanical applications. In some embodiments, the highly-crystalline thermoplastic polymer can include a polyoxymethylene (also known as polyacetal), a polycarbonate, a polybutylene terephthalate (PBT) or a blend thereof. Example of commercially available polyoxymethylenes can include Delrin™ (such as Delrin™ acetal homopolymer resin), Celcon™, Ramtal™, Duracon™, Kepital™ or Hostaform™. Preferably, the ball is made from thermoplastic polymer allowing the ball to slide on the sliding-pad 55 when engaging with the L-shaped lever 50, as will be explained further below.

In accordance with one embodiment illustrated on FIG. 5B, the chime apparatus 10 also includes a pivoting shaft 76 allowing the hammer assembly 40 to be rotatably mounted to the opened bottom end 22 of the support frame 20. The chiming mechanism 70 is inserted into the support frame 20 and the hammer assembly 40 is mounted into the support frame 20, close to the bell 30, via the pivoting shaft 76.

In the illustrated embodiment of FIG. 5A and FIG. 5B, the actuator 72 is a solenoid comprising at least one electrical contact 74, this solenoid being held into an actuator housing 100. The actuator housing 100 is mounted into the support frame 20, and is mechanically connected to the sidewalls 28 of the support frame 20 with bolts, screws, or any other elements allowing the support frame 20 to be joined to the sidewalls 28. A top wall of the actuator housing 100 is traversed by a circular hole 102 allowing the plunger element 80, passing through both the circular hole 102 of the actuator housing 100 and a passage 29 of the support frame 20 to be centered within the solenoid. In the illustrated embodiment, the plunger element 80 extends through the passage 29 and may vertically move into the solenoid via said passage 29.

In operation, the plunger element 80 may be in an engaged or a released position. Upon an actuation signal emitted by the external source and received by the electrical contact 74 of the solenoid, an electric current is applied upon the solenoid, hence exercising a downward force on the plunger element 80, downwardly moving the plunger element 80 within the solenoid, and compressing the spring 82. Preferably, the stopper flange 82 has a diameter greater than the diameter of the circular hole 102 defining the centering element 104, so as to limit the downward movement of the plunger element 80 within the solenoid. The force applied on the plunger element 80 by the solenoid is controlled by the value of the electric current passing through the solenoid. When in the released position, the plunger element 80 is free from any forces and the spring 82 is released.

Now referring to FIG. 6A to FIG. 6G, the use of the chime apparatus 10 according to the embodiment described above to produce a sound, defining a chiming process, will be described in more details.

Figure 6A:
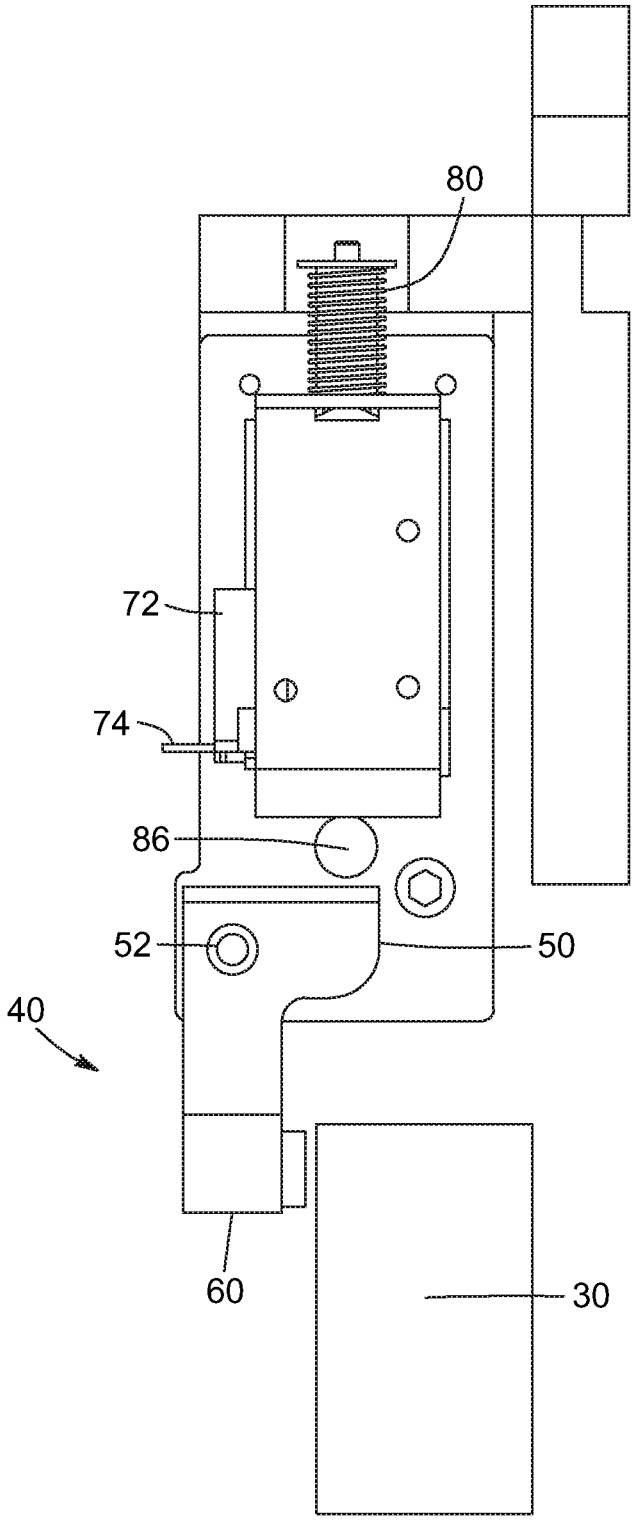
FIG. 6A to 6G illustrate a chiming process to produce a sound.

In FIG. 6A, at the beginning of the chiming process the plunger element 80 is at its highest point within the solenoid, and the contact ball 86 is completely disengaged from the L-shaped lever 50. The hammer assembly 40 is therefore hanging freely about the fulcrum 52, the first lever segment extending vertically downward under the weight of the hammer head 60 which is at rest next to the bell 30.

Figure 6D:
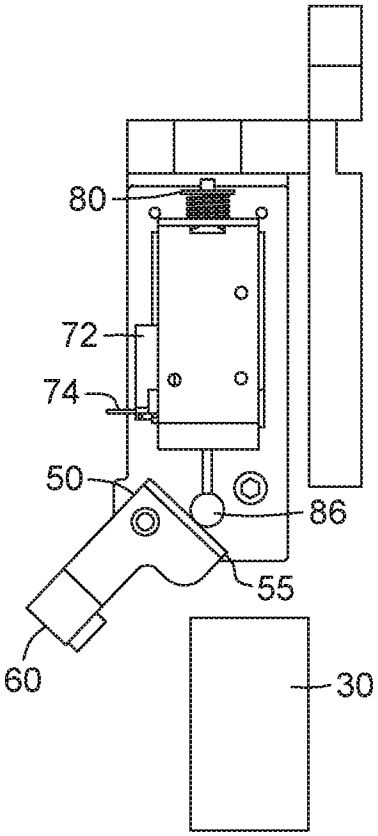
Figure 6C:
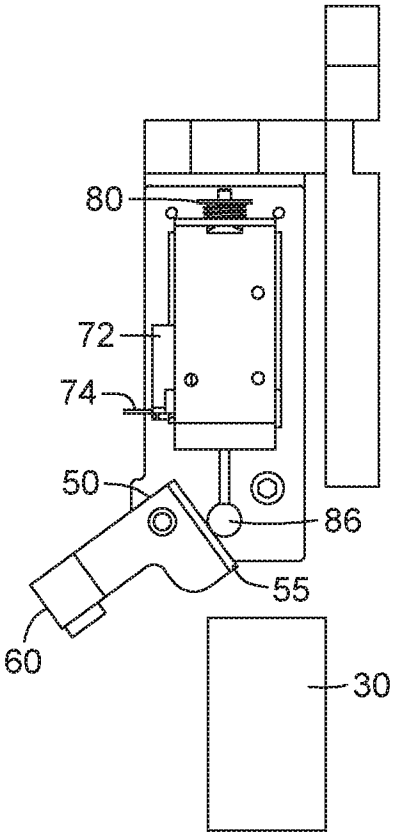
Figure 6B:
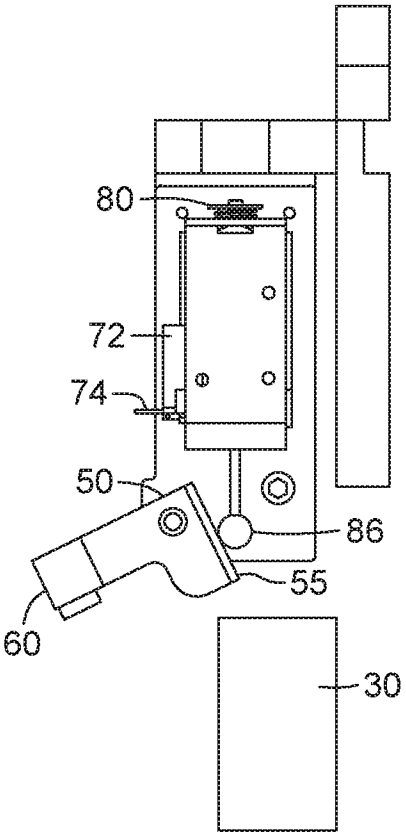
Figure 6G:
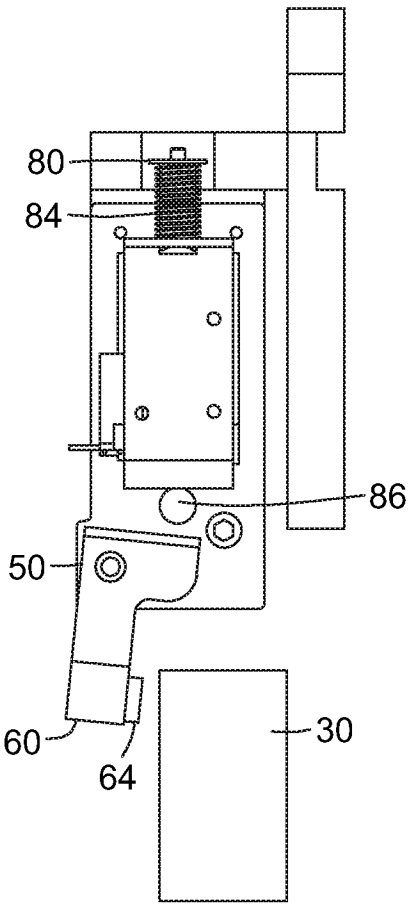

Next, with reference to FIG. 6B to FIG. 6D, the solenoid receives the actuation signal via the electrical contact 74. Following the reception of the actuation signal, an electric current passes through the solenoid, generating a force within the solenoid and exercising a force on the plunger element 80. In response to the force, the plunger element 80 vertically moves downwards towards the engaged position. The spring 84 is compressed and the second lever segment 56 is engaged via the ball 86. The ball 86 moves downwardly and in response the L-shaped lever 50 pivots, as the ball 86 slides on the sliding-pad 55. The hammer head 60 therefore pivots away from the bell 30 at a distance which is proportional to the force applied by the actuator 72 upon the plunger element 80. As an example and referring to FIG. 6B, the plunger element 80 may be maximally engaged and at its lowest vertical position within the solenoid, which results in the maximal distance between the hammer head and the bell. In this example, the power of the produced sound will be maximal. In another example and referring to the embodiment illustrated on FIG. 6C, the plunger element may be intermediately engaged and at an intermediate vertical position, hence maintaining the hammer head at an intermediate distance from the bell. The power of the produced sound by the chime apparatus 10 will then be intermediate. In another embodiment illustrated on FIG. 6D, the plunger element 80 may be minimally engaged, resulting in a minimal distance between the hammer head 60 and the bell 30. In this example, the power of the produced sound will be minimal. The power of the sound produced by the chime apparatus 10 depends on the distance traveled by the hammer head 60 during its fall before striking the bell 30. Although the embodiments illustrated on FIG. 6B to FIG. 6D show a maximal, an intermediate, and a minimal distance between the hammer head 60 and the bell 30, it will be understood that there may be a continuum between the maximal and minimal distance which corresponds to the continuous range of the force that may be applied by the actuator 72 upon the plunger element 80, this force being proportional to the electric current flowing through the solenoid.

Figure 6F:
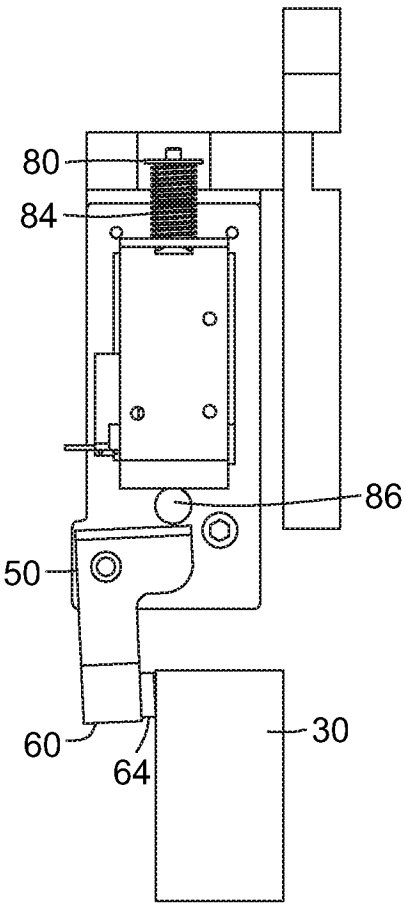
Figure 6E:
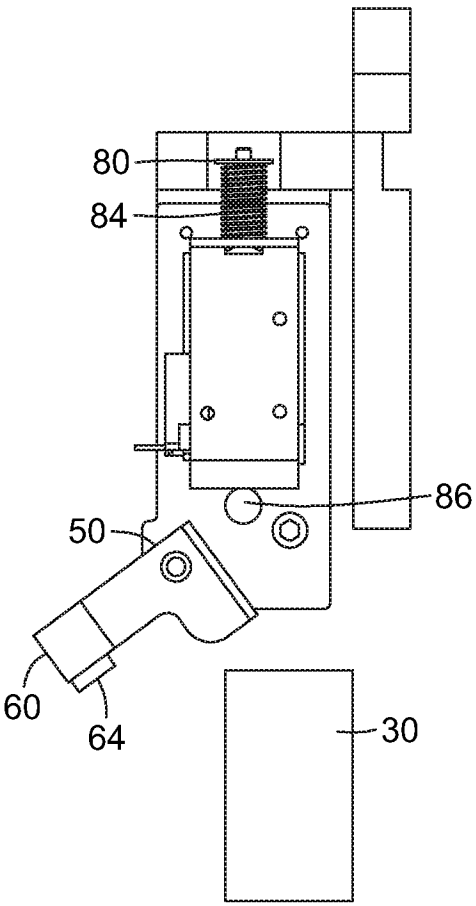

Referring now to FIG. 6E, as a next step in the chiming process the plunger element 80 is released, and moves in an upward direction under the biasing effect of the spring 84, hence releasing the L-shaped lever 50 so that the hammer head 60 falls freely to strike the bell 30. As best seen in FIG. 6F, the L-shaped 50 lever next pivots and the hammer head 60 completes its fall and strikes the bell 30, hence producing a sound. The plunger element 80 preferably moves upwards at a speed that is sufficient for the contact ball 86 to be completely disengaged from the L-shaped lever 50 before the hammer head starts to falls and the contact 64 strikes the bell 30. In the illustrated embodiment of FIG. 6G, the hammer head 60 bounces back from the contact with the bell 30 and moves back to its initial position, as illustrated on FIG. 6A.

Figure 7:
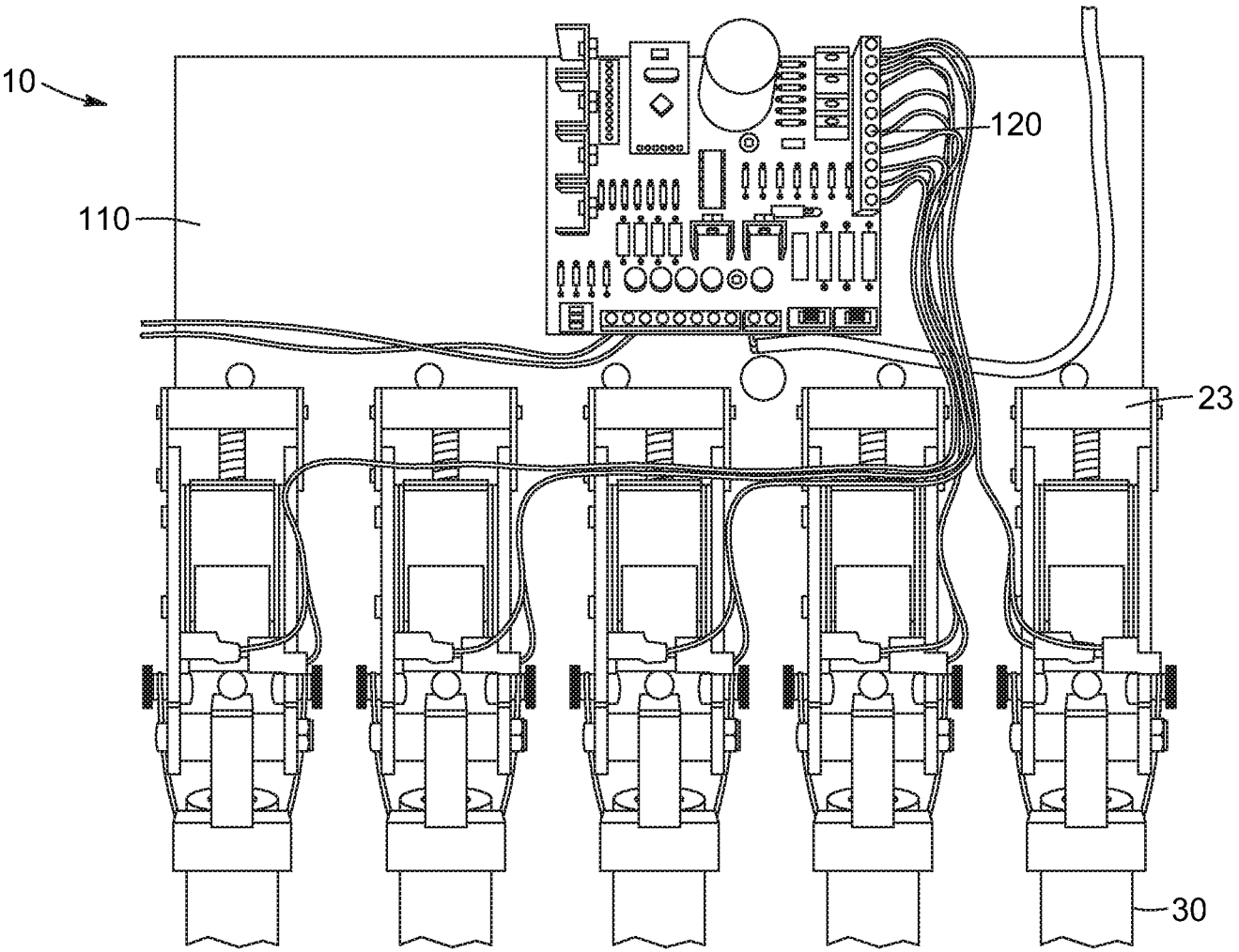
FIG. 7 shows a chime apparatus including five bells controlled by a microcontroller, each bell being independently mounted to a wall-mounted structure.

In some embodiments and now referring to FIG. 7, the chime apparatus 10 may include more than one bell 30, each bell 30 being independently mounted to a wall-mounted structure 110 via its respective mounting bracket 23. Furthermore, each bell 30 is individually and operatively connected to a microcontroller 120, said microcontroller 120 being operatively connected to an external source being configured to receive an actuation signal. Dimensions of the bell 30, including width and length, are optimized with respect with the desired sound to be produced by the chime apparatus 10.

Of course, numerous modifications could be made to the embodiment described above without departing from the scope of the invention.

The invention claimed is:

1. A chime apparatus for producing a sound in response to an actuation signal, the chime apparatus comprising:
- a support frame;
- a bell hanging from the support frame;
- a hammer assembly comprising:
  - an L-shaped lever having a lever fulcrum and being pivotally mounted to the support frame, the L-shaped lever having a first and a second lever segments orthogonally projecting from the lever fulcrum;
  - a hammer head affixed to an extremity of the first lever segment opposite the fulcrum;
- a chiming mechanism comprising:
  - a plunger element being vertically movable in the support frame; and
  - an actuator operatively connected to the plunger element, wherein the chiming mechanism is configured such that in response to the actuation signal, the plunger element moves in a downward direction and engages with the second lever segment of the L-shaped lever, the L-shaped lever pivots, moving the hammer head away from the bell, and wherein the plunger element thereafter moves in an upward direction and releases the L-shaped lever so that the hammer head freely falls to strike the bell to produce the sound.

2. The chime apparatus according to claim 1, wherein the support frame has an opened bottom end.

3. The chime apparatus according to claim 2, wherein the bell is hung from the opened bottom end of the support frame.

4. The chime apparatus according to claim 1, wherein the support frame comprises:
- a mounting bracket;
- a pair of sidewalls suspended from the mounting bracket; and
- suspension elements connecting the sidewalls to the mounting bracket.

5. The chime apparatus according to claim 4, wherein the suspension elements are pieces of felt.

6. The chime apparatus according to claim 1, wherein the bell is a tubular bell having a top opened end and a bottom opened end.

7. The chime apparatus according to claim 6, wherein the bell comprises a hole extending through the bell, proximate the top opened end.

8. The chime apparatus according to claim 7, further comprising a bell hanging assembly, the bell hanging assembly comprising:
- a horizontal slot provided on each one of the pair of sidewalls;
- a bell supporting element mounted to the horizontal slot; and
- a rope passing through the hole of the bell, the rope being attached to the bell supporting element.

9. The chime apparatus according to claim 7, further comprising a bell hanging assembly, the bell hanging assembly comprising:
- a horizontal slot provided on each one of the pair of sidewalls, the horizontal slot including a toothed side comprising a plurality of individual tooth; and
- a rope passing through the hole of the bell, the rope being engaged with one individual tooth of the toothed side of the horizontal slot.

10. The chime apparatus according to claim 1, wherein the L-shaped lever is made of acrylic.

11. The chime apparatus according to claim 1, wherein the L-shaped lever has a top surface provided with a sliding pad.

12. The chime apparatus according to claim 1, wherein the hammer head is a balanced weight.

13. The chime apparatus according to claim 12, further comprising a contacting element affixed to the hammer head, the contacting element being positioned to contact the bell when the hammer head strikes the bell.

14. The chime apparatus according to claim 1, wherein the plunger element comprises:
- a top portion including:
  - a plunger shaft having a top end and a bottom end;
  - a stopper flange attached to a top end of the plunger shaft; and
  - a spring wound about the plunger shaft; and
- a bottom portion including:
  - a plunger stem mechanically connected to the bottom end of the plunger shaft; and a contact ball fastened at a bottom end of the plunger stem.

15. The chime apparatus according to claim 14 wherein the contact ball is made of high-crystalline thermoplastic polymer.

16. The chime apparatus according to claim 1, further comprising a pivoting shaft, wherein the L-shaped lever is pivotally mounted to the support frame with the pivoting shaft.

17. The chime apparatus according to claim 1, wherein the actuator is a solenoid.

18. The chime apparatus according to claim 17, further comprising an actuator housing for housing the solenoid, the actuator housing being mounted into the support frame and having a top wall traversed by a hole.

19. The chime apparatus according to claim 1, wherein the actuator is configured to receive the actuation signal from an external source.

* * * * *